United States Patent [19]

Nentchev

[11] Patent Number: 4,869,244

[45] Date of Patent: Sep. 26, 1989

[54] VALVE-TALKING DEVICE

[76] Inventor: Valentin N. Nentchev, 44, Dospat Street,, 1463 Sofia, Bulgaria

[21] Appl. No.: 184,457

[22] Filed: Apr. 21, 1988

[51] Int. Cl.[4] ..... A62B 18/08

[52] U.S. Cl. ..... 128/201.19; 128/205.25

[58] Field of Search ..... 128/201.19, 205.25, 128/200.24

[56] References Cited

U.S. PATENT DOCUMENTS

| | | | |
|---|---|---|---|
| 1,730,227 | 10/1929 | McBride | 128/201.19 |
| 4,539,983 | 9/1985 | Angell | 128/201.19 |

FOREIGN PATENT DOCUMENTS

| | | | |
|---|---|---|---|
| 2643853 | 3/1978 | Fed. Rep. of Germany . | |
| 3446771 | 7/1985 | Fed. Rep. of Germany . | |
| 859582 | 12/1940 | France | 128/201.19 |
| 572888 | 10/1945 | United Kingdom | 128/201.19 |
| 660095 | 10/1951 | United Kingdom | 128/201.19 |

*Primary Examiner*—Edgar S. Burr
*Assistant Examiner*—Aaron J. Lewis

[57] ABSTRACT

A valve-talking device for use in gas masks has two coaxially disposed tubes which are connected together in the front end by a partition that may be a conic expansion of the inner tube. In the space formed between both tubes valves for the exhaled air are mounted. In the portion of the outer tube disposed between the partition and the valves, openings for exhaled air are disposed and the outlet of the front end of the inner tube is closed hermetically by the talking device.

The valves for the exhaled air have an annular valve seat and valve membrane which encompass the inner tube.

15 Claims, 2 Drawing Sheets

VALVE-TALKING DEVICE

FIELD OF THE INVENTION

This invention refelates to a valve-talking device useful in gas masks with different constructions intended for various purposes.

BACKGROUND OF THE INVENTION

There are known valves for exhaled air and talking devices based upon a membrane vibrating under the action of sonoric waves that are intended for gas masks. The valve for the exhaled air and the talking devices are disposed in the gas masks entirely separated or integrated in a joint body with eccentrically disposed axes. The exhaled valves consist of a membrane that is fastened in the center to the valve seat. These known devices are disclosed in German patent document Nos. DE-OS-2 643 853 and DE-OS-3 446 771.

The disadvantages of these described devices are that they occupy a considerable area of the gas mask; they require a displacement of the talking device or of the valves for the exhaled air with respect to the direction of the exhaled air stream; there is relatively small area and elastically of the valves for the exhaled air; there is a considerable resistance of these valves per area unit; it is necessary to have a considerable volume of harmful space around the amount and nose; there are limited possibilities to obtain a sufficient volume of the physiological chamber between consecutively disposed exhaling valves when there is a need to reach a particularly high degree of protection with regard to strong toxic gases.

It is therefore an object of the invention to avoid or reduce to a minimum the above cited disadvantages in providing a compact valve-talking device occupying a minimal part of the gas mask surface and ensuring a high degree of functional protection from toxic substances, a low resistance to exhalation, the possibility for unhampered talking and a minimal volume of harmful space around the nose and mouth.

SUMMARY OF THE INVENTION

These and other objects are attained by a valve-talking device comprising two coaxially disposed tubes which are connected together in the front end by means of a partition that may be a conic expansion of the inner tube. In the space formed between both tubes valves for the exhaled air are mounted. In the portion of the outer tube, disposed between the partition and the valves, openings for the exhaled air are disposed and the outlet of the front end of the inner tube is closed hermetically by a talking device.

The valves for the exhaled air can have a different construction suitable for a particular case as for example valves consisting of a vlave seat and a valve membrane with central openings encompassing the inner tube.

The valve seat can be a disk with a central opening encompassing, in case of mounting, the inner tube and openings for the exhaled air may be disposed concentrically to the central opening.

The valve membrane can be an elastic disk with a central opening embracing, in case of mounting, the inner tube. It can be unilaterally or bilaterally ribbed or have a stepwise profile.

The advantages of this invention are that it provides the ability to eliminate all elements from the side walls of the mask and to permit an optimal approach of the same to the face. The port glass can be disposed very near to the eyes thus increasing the angle of vision and making it possible to work with optical devices. The talking device and the valves for exhaling air are situated at one axis in immediate proximity to the mouth so that the exhaled air stream and the sonoric waves arrive directly in the shortest possible way to the valves and the talking device. The large area of the valves and the specific fastening of the valve membranes allow for a low resistance of exhaling along with a considerable reduction of the time which is needed for their closing after the end of exhaling which is very important to avoid any penetration of toxic substances through them. As a result, the area occupied by the valve-talking device in the front part of the gas mask practically does not surpass the area occupied by the talking device itself.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
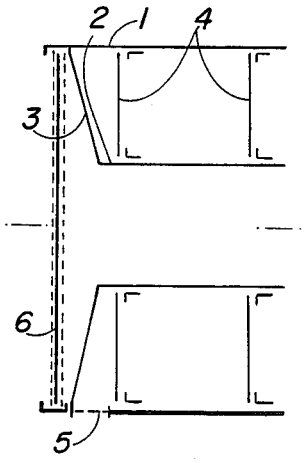
FIG. 1 is a schematic longitudinal cut of the device.
Figure 2:
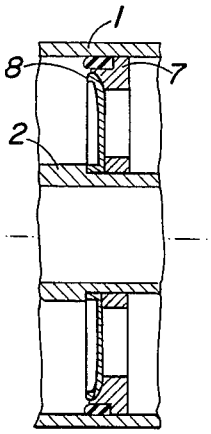
FIG. 2 is a diametrical cut of the valve for exhaled air.

Referring now to FIGS. 1 and 2, the inventive valve-talking device comprises an outer tube 1 and an inner tube 2 disposed coaxially with respect to each other, both tubes being connected in their front part of a partition 3 representing a conic expansion of the inner tube 2. In the space formed between the two tubes 1 and 2, valves 4 for the exhaled air are mounted. In the portion of the outer tube 1, situated between the partition 3 and the frontmost valve 4 for the exhaled air, openings for the exhaled air 5 are disposed. In front of the partition 3, the talking device 6 is mounted and hermetically seals the front end outlet of the inner tube 2.

Referring specifically to FIG. 2, the valve 4 for the exhaled air comprises a valve seat 7 and a valve membrane 8 and it is closely mounted between the outer tube 1 and the inner tube 2.

Figure 3:
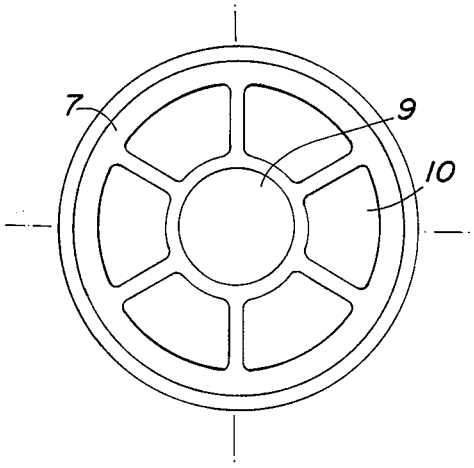
FIG. 3 is a counter-view of the valve seat.

As seen in FIG. 3, the valve seat 7 represents a disk with central aperture 9 and openings 10 for the exhaled air that are disposed concentrically to the central aperture 9.

Figure 4:
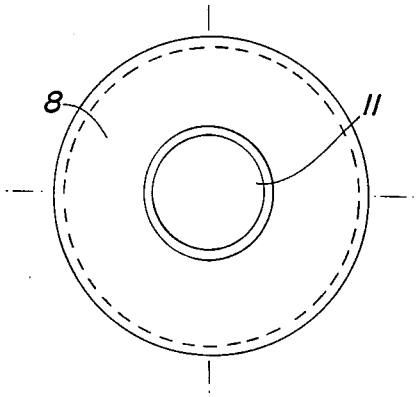
FIG. 4 is a counter-view of the valve membrane.
Figure 5A:
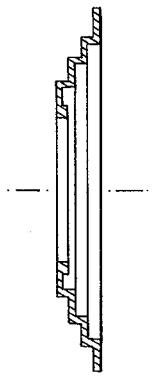
FIGS. 5*a* and 5*b* are alternative embodiments of the membrane of FIG. 5 as seen in cross-section along the line A—A of FIG. 5.
Figure 5:
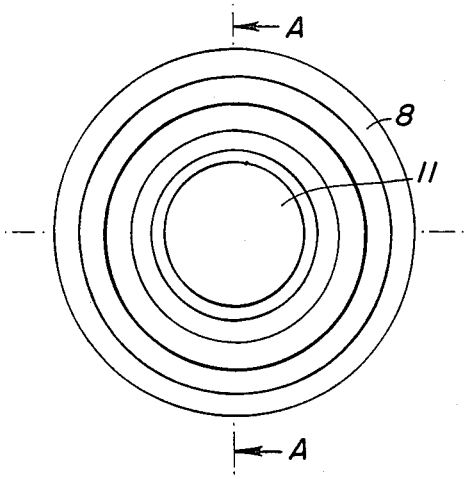
FIG. 5 is a view similar to FIG. 4 of a valve membrane with a stepped profile.
Figure 5B:
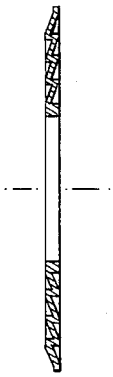
Figure 6A:
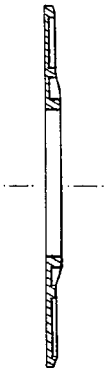
FIGS. 6*a* and 6*b* are alternative embodiments of the membrane of FIG. 6 as seen in cross-section along the line A—A of FIG. 5, respectively a one sided rib and a two sided rib.
Figure 6:
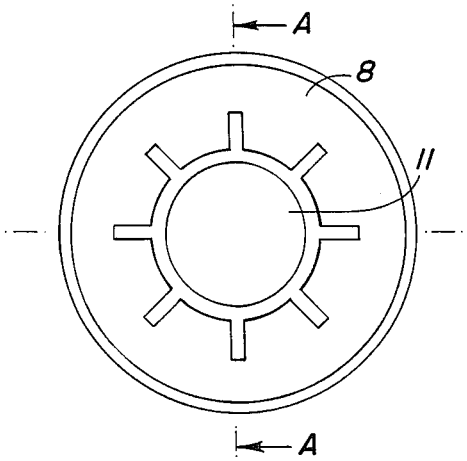
FIG. 6 is a view similar to FIGS. 4 and 5 of a ribbed valve membrane.
Figure 6B:
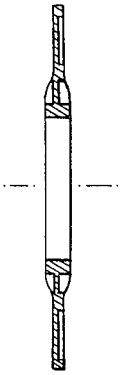

As shown in FIG. 4, the valve membrane 8 represents an elastic disk with central aperture 11 and it can be unilaterally or bilaterally ribbed as shown in FIGS. 6, 6*a*, and 6*b* or have a stepwise profile as shown in FIGS. 5, 5*a*, and 5*b*.

The valve-talking device operates as follows:

The exhaled air surmounting the resistance of valves 4 is exhausted in the surrounding atmosphere through the openings 5. The acoustic vibrations are transmitted by the inner tube 2 to the membrane 6 of the talking device and from it to the surrounding space. The penetration of unpurified air from the surrounding atmosphere back through the valves 4 is avoided by their very rapid closing after the end of exhaling. In the case of eventual penetration of an insignificant amount of contaminated air through the first valve at the moment of its closing this air remains closed in the physiological chamber formed by the two consecutively disposed valves 4 (as shown in FIG. 1) and then it is exhausted back to the atmosphere during the next exhaling. Thus is excluded any possibility that unpurified air can pass through the valve-talking device to the interior of the gas mask.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A valve-talking device suitable for use in a gas mask, said device comprising:

an outer tube and a coaxially disposed inner tube, said tubes each having a front part and a rear part, said rear parts connected to said gas mask, and said tubes defining an annular space between each other, both tubes being connected to each other at their respective front parts by a partition;

said partition being an extension of said inner tube and being gas-tight;

a plurality of annular valves mounted in said annular space between the rear part of said tubes and said partition; said valves comprising means .to allow exhaled gases to pass through said valves and prevent any gases from being inhaled said valves each comprising a valve seat and a valve membrane;

said outer tube having an opening located between said partition and a first one of said plurality of valves;

the front part of said inner tube being hermetically sealed by a talking device, said talking device comprising a membrane.

2. A valve-talking device as claimed in claim 1, further comrising said valve seat being an annular disk provided with a plurality of openings.

3. A valve-talking device as claimed in claim 1, further comprising said valve membrane being an elastic annular disk.

4. A valve-talking device as claimed in claim 1, further comprising said valve membrane being an elastic annular disk having a ribbed surface.

5. A valve-talking device as claimed in claim 1, further comprising said valve membrane being an elastic annular disk having a stepped profile.

6. A valve-talking device suitable for use in a gas mask, said device comprising an outer tube and a coaxially disposed inner tube, said tubes each having a front part and a rear part, and said tubes defining an annular space between each other, both tubes being connected to each other at their respective front parts by a partition;

a pluralty of annular valves mounted in said annular space between the rear part of said tubes and said partition;

said valves each comprising a valve seat and a valve membrane;

said valves comprising means to allow exhaled gases to pass through said valve and prevent any gases from being inhaled;

said outer tube having an opening located between said partition and a first one of said plurality of valves;

the front part of said inner tube being hermetically sealed by a talking device, said talking device comprising a membrane.

7. A valve-talking device as claimed in claim 6, further comprising said valve seat being an annular disk provided with a plurality of openings.

8. A valve-talking device as claimed in claim 6, further comprising said valve membrane being an elastic annular disk.

9. A valve-talking device as claimed in claim 6, further comprising said valve membrane being an elastic annular disk having a ribbed surface.

10. A valve-talking device as claimed in claim 6, further comprising said valve membrane being an elastic annular disk having a stepped profile.

11. A valve-talking device suitable for use in a gas mask, said device comprising an outer tube and a coaxially disposed inner tube, said tubes each having a front part and a rear part, and said tubes defining an annular space between each other, both tubes being connected to each other at their respective front parts by a partition;

a plurality of first and second annular valves mounted in said annular space between the rear part of said tubes and said partition;

said second annular value being mounted between the rear part of said tubes and said first annular valves;

said valves each comprising a valve seat and a valve membrane;

said outer tube having an opening located between said partition and said first annular valve;

the front part of said inner tube being hermetically sealed by a talking device, said talking device comprising a membrane.

12. A valve-talking device as claimed in claim 11, further comprising said valve seat being an annular disk provided with a plurality of openings.

13. A valve-talking device as claimed in claim 11, further comprising said valve membrane being an elastic annular disk.

14. A valve-talking device as claimed in claim 11, further comprising said valve membrane being an elastic annular disk having a ribbed surface.

15. A valve-talking device as claimed in claim 11, further comprising said valve membrane being an elastic annular disk having a stepped profile.

* * * * *